US007719241B2

(12) United States Patent
Dean

(10) Patent No.: US 7,719,241 B2
(45) Date of Patent: May 18, 2010

(54) AC-COUPLED EQUIVALENT SERIES RESISTANCE

(75) Inventor: James Robert Dean, Redmond, WA (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 11/369,266

(22) Filed: Mar. 6, 2006

(65) Prior Publication Data

US 2007/0210770 A1 Sep. 13, 2007

(51) Int. Cl.
*G05F 1/00* (2006.01)

(52) U.S. Cl. ..... 323/273

(58) Field of Classification Search ..... 323/273, 323/280, 281, 274, 269, 272, 326; 327/543
See application file for complete search history.

(56) References Cited

U.S. PATENT DOCUMENTS

| | | | | |
|---|---|---|---|---|
| 4,354,200 | A * | 10/1982 | Haenen et al. | 348/642 |
| 4,636,710 | A | 1/1987 | Stanojevic | 323/280 |
| 4,902,959 | A | 2/1990 | Brokaw | 323/314 |
| 4,928,056 | A | 5/1990 | Pease | 323/314 |
| 5,274,323 | A | 12/1993 | Dobkin et al. | 323/280 |
| 5,394,078 | A | 2/1995 | Brokaw | 323/313 |
| 5,406,222 | A | 4/1995 | Brokaw | 330/257 |
| 5,467,009 | A | 11/1995 | McGlinchey | 323/269 |
| 5,563,501 | A | 10/1996 | Chan | 323/282 |
| 6,044,027 | A * | 3/2000 | Zheng et al. | 365/194 |
| 6,765,374 | B1 * | 7/2004 | Yang et al. | 323/280 |
| 6,861,827 | B1 * | 3/2005 | Yang et al. | 323/273 |
| 2006/0267564 | A1 * | 11/2006 | Badami | 323/274 |
| 2007/0030074 | A1 * | 2/2007 | W. Ritter | 330/292 |

OTHER PUBLICATIONS

Paul Horowitz, Winfield Hill, The Art of Electronics, Cambridge University Press, New York, 1989, pp. 98-104.

* cited by examiner

*Primary Examiner*—Edward Tso
*Assistant Examiner*—Arun Williams
(74) *Attorney, Agent, or Firm*—Koppel, Patrick, Heybl & Dawson

(57) ABSTRACT

AC-coupled equivalent series resistance (ESR) is introduced into a control circuit to provide additional stability in the feedback control loop. A sub-circuit emulates the effect of a higher value ESR in the output capacitor. The additional ESR in the feedback control loop inserts a zero into the transfer function that describes the circuit response at a desired frequency. The added zero compensates for the effects of unwanted or unavoidable poles in the transfer function, allowing for a greater range of input signal frequencies.

23 Claims, 6 Drawing Sheets

AC-COUPLED EQUIVALENT SERIES RESISTANCE

BACKGROUND OF THE INVENTION

1. Field of the Invention

The present invention relates generally to modern control systems and, more particularly, to negative feedback loops in such systems.

2. Description of the Art

FIG. 1 illustrates a known control system utilizing a negative feedback loop in a low drop-out (LDO) amplifier application 100. This particular application 100 is configured as an LDO regulator circuit. An LDO regulator is a circuit that provides a well-specified and stable DC voltage. The lowest value of differential (input/output) voltage at which the control loop stops regulating is called the dropout voltage. Modern applications such as communication electronics and other battery-powered portable devices require a low dropout voltage and low quiescent currents for increased power efficiency. LDO regulators meet both of these design needs.

At the input stage, a reference input signal $V_{REF}$ is fed into the inverting input of a dual stage amplifier 104. The output from the amplifier controls a field effect transistor (FET) $Q_1$ that acts as a switch for supplying current from the power source $V_{DD}$ to the load (modeled as a resistor $R_L$ in the figure). Some of the current flowing between the source and the drain of $Q_1$ is then fed back through a simple RC filter network into the non-inverting input of the amplifier 104. This feedback signal is called $V_{FB}$. The RC filter network comprises capacitor $C_1$ and resistors $R_1$ and $R_2$. $C_1$ AC-couples the output back into amplifier 104. Resistors $R_1$ and $R_2$ are configured in a voltage divider with $R_2$ connected to ground. The ratio between the values of $R_1$ and $R_2$ may be adjusted to set the output voltage, $V_{OUT}$, to a desired value.

$V_{OUT}$ is fed back through the RC filtering network yielding signal $V_{FB}$ at the non-inverting input of the amplifier. Typically, differential amplifiers are used in modern electronic circuits. Differential amplifiers amplify the voltage difference between two input signals. When the output of a differential amplifier is connected to its inverting input and a reference voltage signal is applied to the non-inverting input, the output voltage of the op-amp closely follows that reference voltage. As the amplifier output increases, that output voltage is fed back to the inverting input, thereby acting to decrease the voltage differential between the inputs. When the input differential is reduced, the amplifier output and the system gain are also reduced. In FIG. 1, because amplifier 104 is a dual-stage amplifier, the reference signal is shown connected to the inverting input rather than the non-inverting input. Nevertheless, because the output is fed back in a manner that reduces the system gain, the result is negative feedback, sometimes called degenerative feedback.

Negative feedback is often employed to stabilize a control system when the system exhibits a gain from the input to the output. The output stage 120 in this LDO application is modeled by load resistor $R_L$ and an output capacitor $C_0$ which is needed to deliver an instantaneous current to a dynamic load. $C_0$ has a characteristic equivalent series resistance (ESR) modeled by a series resistor $R_{ESR}$. ESR is an effective resistance that is used to describe the resistive part of the impedance of certain electrical components such as capacitors.

An important characteristic of this type of control circuit is the ratio between the output and input signal amplitudes, known as the transfer function. The transfer function for any given system is used to model the gain of the system as a function of the input signal frequency. Such control systems are often designed to meet the specifications of a transfer function. The frequency response of the control system is completely described by its transfer function. As such, the stability of a system over a range of input signal frequencies may be predicted based upon properties of its transfer function known as poles and zeros. A pole is a root of the polynomial denominator of a transfer function; a zero is a root of the polynomial numerator.

In designing stable systems, one important consideration is the shift in phase that a signal undergoes as it passes through the system. Poles and zeros are associated with these shifts in phase. If the signal accumulates a shift in phase of 180 degrees, the shift causes the negative feedback to become positive feedback. This is problematic when the system is operating at greater than unity gain as positive feedback will drive the system to an unstable oscillatory state. In order to maintain the stability of the control system, designers often build in a phase shift buffer, called a phase margin. For example, a 50 degree phase margin ensures that the signal never undergoes a phase shift of more than about 130 degrees (i.e. it never comes within approximately 50 degrees of a 180 degree phase shift). 50 degrees is a typical value of a phase margin in an LDO design; however, a 50 degree phase margin is not a requirement for stability and smaller phase margins of 45 degrees or lower may suffice. Furthermore, although a design goal may be to maintain a particular phase margin, the actual performance of a system may be less than the nominal phase margin value. The nominal value of the phase margin is chosen to meet the specifications of a particular design and may vary significantly.

Both poles and zeros can be introduced into the transfer function describing the control loop by inserting various electronic components into the loop. For example, a dual-stage amplifier will create two poles in the transfer function. The addition of poles and zeros into the frequency response of a system must be taken into account in order to design a system with a bounded (finite) output. Unwanted or unavoidable poles and zeros can create significant challenges when trying to stabilize a control system over a range of operating frequencies.

Previously, efforts have been made to stabilize a control system by designing the system so that troublesome poles only affect the system negligibly over the operating frequency range. This approach limits the designer to specific component values and configurations. For example, an output stage may include a capacitor having an ESR which adds a zero to the transfer function at a certain frequency. In order to realize a stable system, the capacitor must be limited to values such that the added zero does not interfere with the system response over the input frequency range. For this reason, small variations in the value of the ESR in an output capacitor can have a significant destabilizing effect on the entire system. A major goal of electronic system design is to avoid limiting circuit components to a precise value or range of values, allowing for easy replacement and substitution of components.

Another previous effort to stabilize control systems involves raising the quiescent current. The quiescent current, sometimes called the leakage current, is the portion of the input current that does not contribute to the load current. In other words, it is the current that the system consumes when no load current is being supplied. By raising the quiescent current, non-dominant poles in the system can be pushed to much higher frequency levels outside the system's normal operating range. A drawback of this stabilization method is that a higher quiescent current drains the batteries that power the system. For this reason many modern applications demand a low quiescent current for increased battery lifetime.

SUMMARY OF THE INVENTION

The present invention seeks to provide a novel control circuit and associated method for improving the stability of feedback loops in control circuits. The invention allows control system electronics to be designed with greater flexibility in component choice and improved stability over a broader range of input frequencies.

These goals are achieved, according to one embodiment of the invention, by providing a control circuit with a negative feedback control loop that includes at least one input stage and at least one output stage, the output stage having an associated ESR. The control circuit further includes a sub-circuit that emulates a second ESR. The second ESR is a scaled version of the ESR of the output stage and is AC-coupled into the control loop at a desired frequency.

An associated method for improving the stability of feedback loops couples an amplified signal back into an amplifying device to produce a negative feedback control loop having a characteristic transfer function. An ESR is emulated within the control loop to introduce a zero into the transfer function at a desired frequency.

These and further features and advantages of the invention will be apparent to those skilled in the art from the following detailed description, taken together with the accompanying drawings, in which:

DETAILED DESCRIPTION OF THE INVENTION

Figure 1:
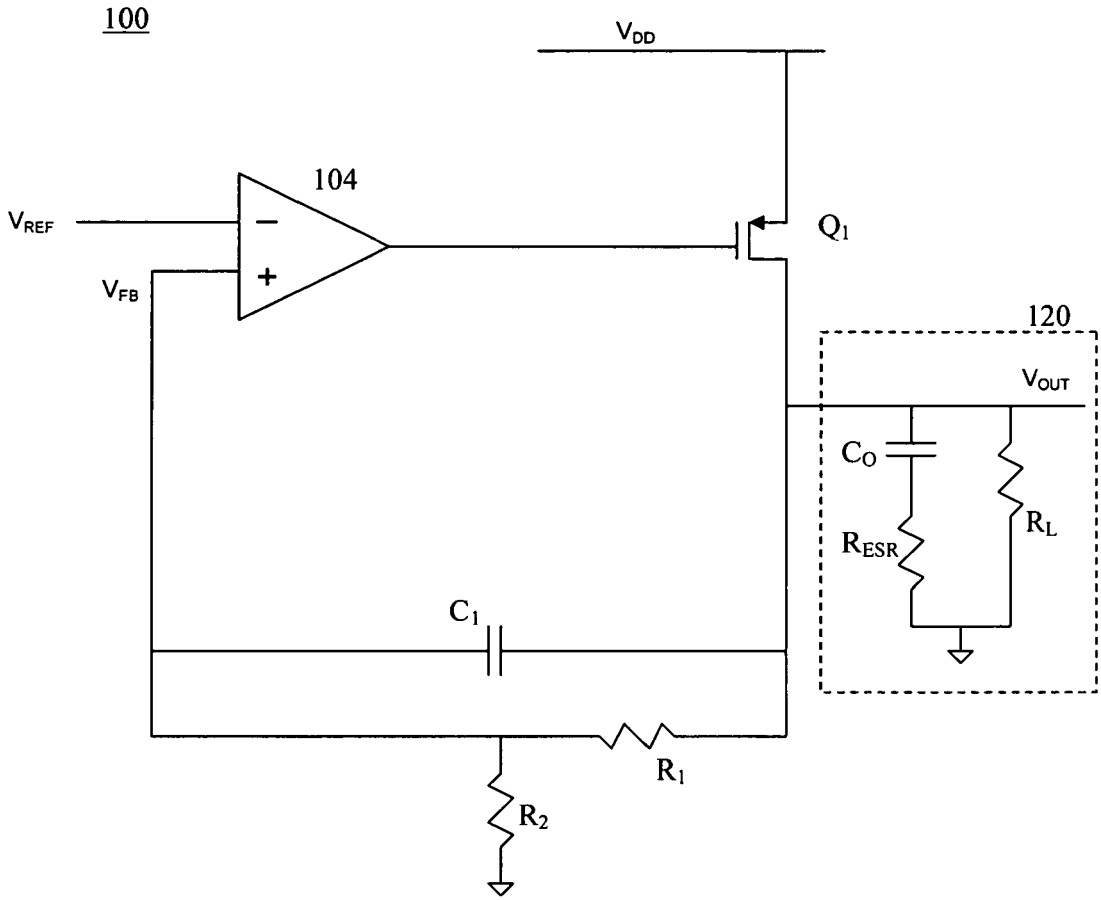
FIG.1 (prior art)
FIG. 1 is a schematic diagram of a prior art low dropout (LDO) regulator circuit.
Figure 2:
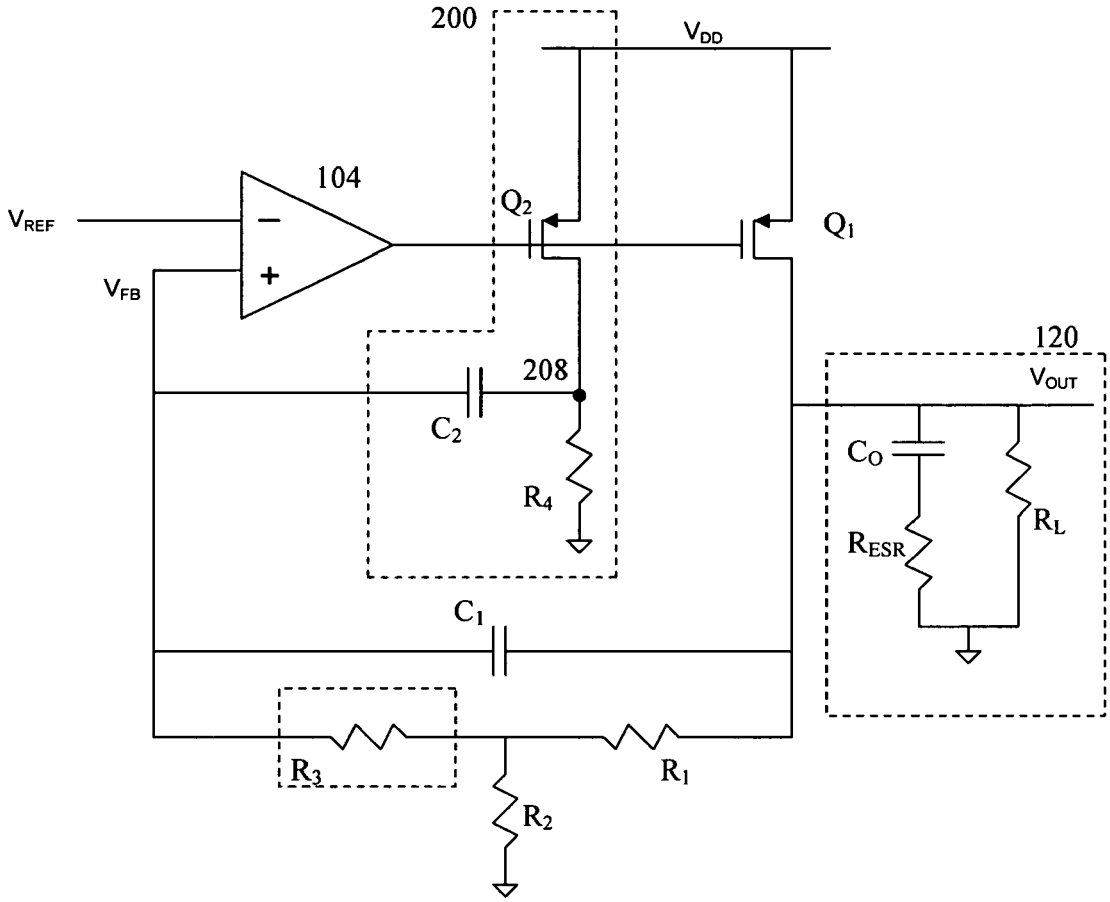
FIGS. 2, 3, 4 and 5 are schematic diagrams of an LDO regulator circuit featuring different respective embodiments of the present invention.

FIG. 2 illustrates one embodiment of a novel control circuit. The control circuit exhibits improved stability over the prior art for a broad range of input frequencies by emulating an ESR within the circuit and adding a zero to the transfer function at a desired frequency. The design is more immune to variations in the actual ESR of the output capacitor and other board parasitic elements such as trace inductance in series with the output capacitor. The control circuit is designed to drive a wide variety of load circuits. Some examples of such load circuits are a processor, an amplifier, a digital to analog converter or a pulse width modulation switching regulator.

The control circuit shown in FIG. 2 is an LDO regulator application with an additional emulated ESR that is AC-coupled into the system control loop to stabilize the system. The sub-circuit 200 is an example of one circuit that may be used to emulate the additional ESR.

In this embodiment sub-circuit 200 comprises a feedback FET $Q_2$ and an RC network consisting of coupling capacitor $C_2$ and resistor $R_4$. $C_2$ connects the drain of $Q_2$ to the non-inverting input of amplifier 104, and $R_4$ connects the drain of $Q_2$ to ground. The base of $Q_1$ is connected to the base of $Q_2$, allowing $Q_2$ to function as a current mirror that outputs a scaled version of the current flowing through $Q_1$. The scaling factor is adjusted by varying the width of $Q_2$. If the width of $Q_2$ is increased, more current flows through sub-circuit 200 increasing the gain around the loop and the emulated ESR. Because the size of $Q_1$ is determined by the maximum current that it is required to supply, the width of $Q_1$ always remains the same for a given load (modeled here as $R_L$).

The current flowing through $Q_2$ is supplied to the RC network through node 208. The components of the RC network are chosen to emulate $C_0$ with an ESR that is scaled in proportion to the ESR of $C_0$. The voltage produced at node 208 is AC-coupled through $C_2$ and contributes to signal $V_{FB}$. An additional resistor $R_3$ is needed between the junction of resistors $R_1/R_2$ and the non-inverting input amplifier 104 when the control circuit is designed to operate at unity gain (i.e. when the value of $R_1$ is zero ohms).

The ESR of sub-circuit 200 adds a zero to the characteristic transfer function of the loop. A pole that accompanies this zero is at a much higher frequency and has negligible effect on the stability of the control loop. The designer can easily adjust the value of the emulated ESR, and hence the frequency position of the added zero, by changing the size of the components that compose sub-circuit 200.

Equation 1 shows the relationship between the frequency of the added zero ($f_{zero}$) and the values of several components in the circuit where $R_4$ is the value of the emulated ESR and N is the ratio of the widths of $Q_2$ over $Q_1$:

$$f_{zero} = \frac{1}{2\pi \cdot N \cdot R_4 \cdot C_O} \cdot \frac{C_1}{C_2} \qquad \text{Equation 1}$$

As a result of the emulated ESR, the control circuit is stable over a desired range of input frequencies. Signal $V_{OUT}$ is thus able to drive load $R_L$ within the desired range.

Figure 3:
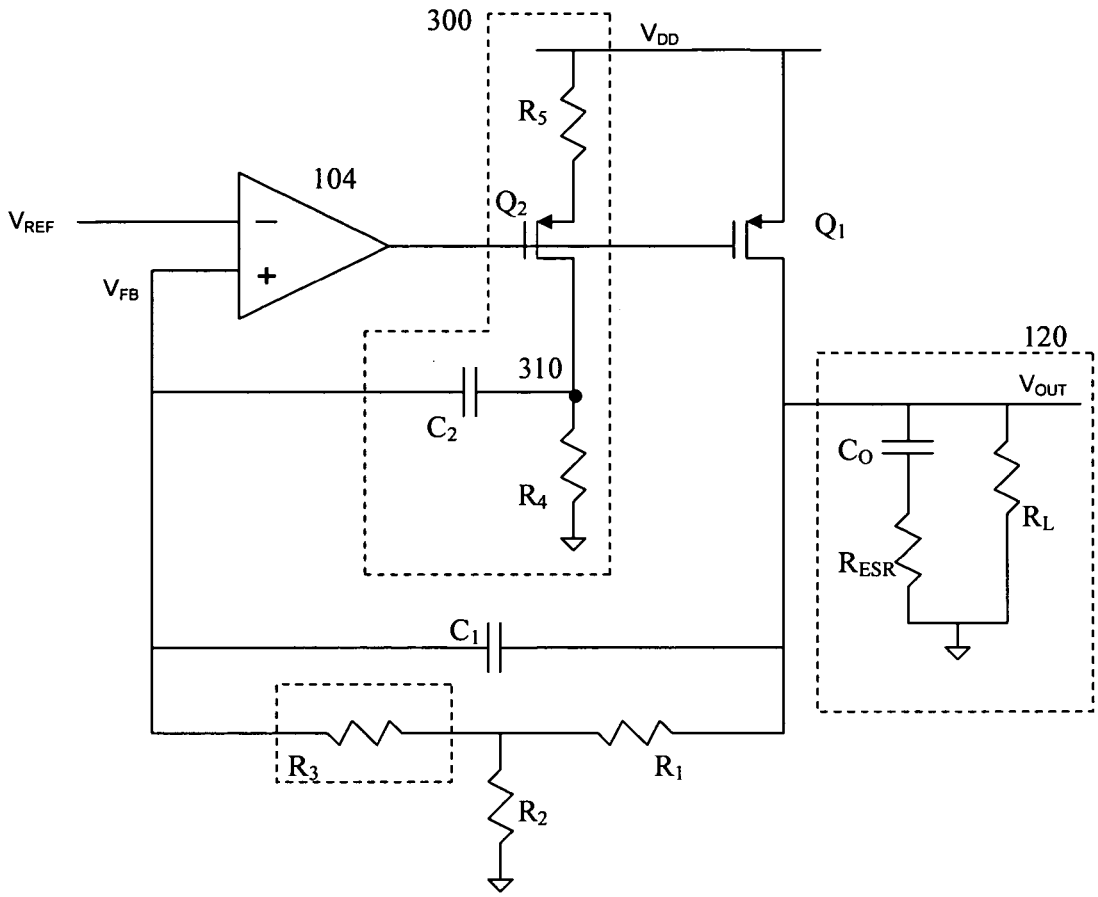

Another embodiment of the new control circuit is illustrated in FIG. 3, in which an LDO regulator device is similar to the one illustrated in FIG. 2. Sub-circuit 300 includes the same components and has the same structure as sub-circuit 200 except that sub-circuit 300 comprises an additional resistor $R_5$ connecting $V_{DD}$ and the source of $Q_2$.

Adding an additional resistance $R_5$ between $V_{DD}$ and $Q_2$ reduces the gain around the loop (through node 310 back to the input of amplifier 104) when the system is operating at higher load levels. As load levels increase, higher order poles and zeros that were not significant at lower load levels begin to impact the system response. For this reason the designer may wish to push the zero added by the emulated ESR to higher frequencies to compensate for these higher order poles and zeros. This can be accomplished by decreasing the gain around the loop including sub-circuit 300. Equation 1 shows how changing various component values will affect the frequency of the added zero.

The current flowing through $Q_2$ is proportional to the current flowing through $Q_1$. This proportion is adjusted by changing the width of $Q_2$. If the width of $Q_2$ is increased, the gain around the loop through node 310 (defined by the junction of $Q_2$, $C_2$ and $R_4$) is increased and the frequency of the added zero is reduced. The current flowing through $Q_2$ travels into the RC network, producing a voltage at node 310. The voltage produced at node 310 is AC-coupled through $C_2$ to signal $V_{FB}$. An additional ESR is emulated by sub-circuit 300, inserting a zero into the transfer function at a desired frequency.

Figure 4:
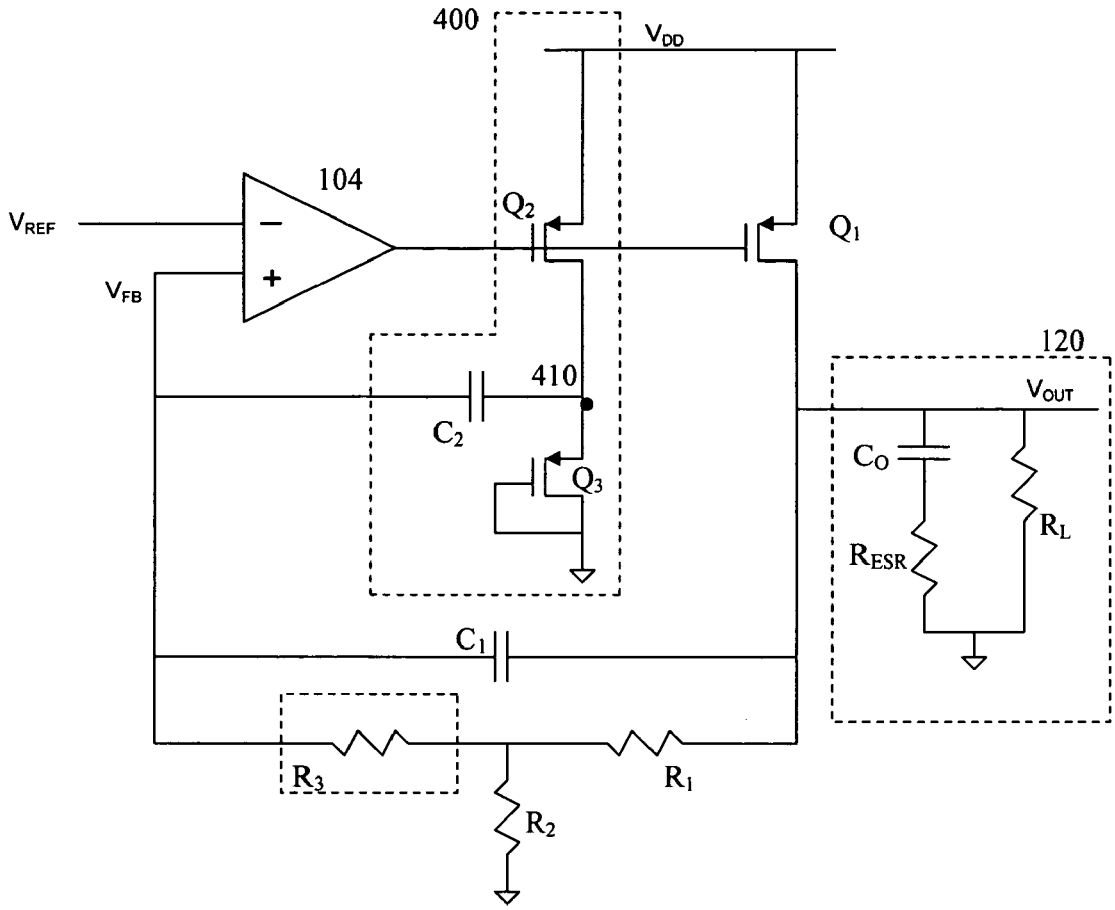

Another embodiment of the new control circuit is illustrated in the LDO regulator application of FIG. 4. The regulator device is the same as the one illustrated in FIG. 2 except that sub-circuit 400 includes a tracking FET $Q_3$ in place of $R_4$.

Node 410 is defined by the junction of $Q_2$ and $Q_3$. The drain and gate of $Q_3$ are both connected to ground. As explained above, the current flowing through the loop including sub-circuit 400 is proportional to the load current. In this configuration the resistance of $Q_3$ decreases proportional to the square root of the current flowing through it. Thus, $Q_3$ provides sub-circuit 400 with a variable resistance, and thus a variable ESR, that scales itself in proportion to the current through load $R_L$.

The variable ESR of $Q_3$ provides for greater system stability when the control circuit is designed to drive a dynamic load (not shown). The output current needed to supply a dynamic load can change drastically and rapidly. As the load current changes, so do the positions of certain poles in the transfer function. This necessitates a dynamic zero to compensate for the effect of the dynamic pole. Tracking FET $Q_3$ is connected to produce a zero that tracks a dynamic pole resulting from a non-static load current.

Figure 5:
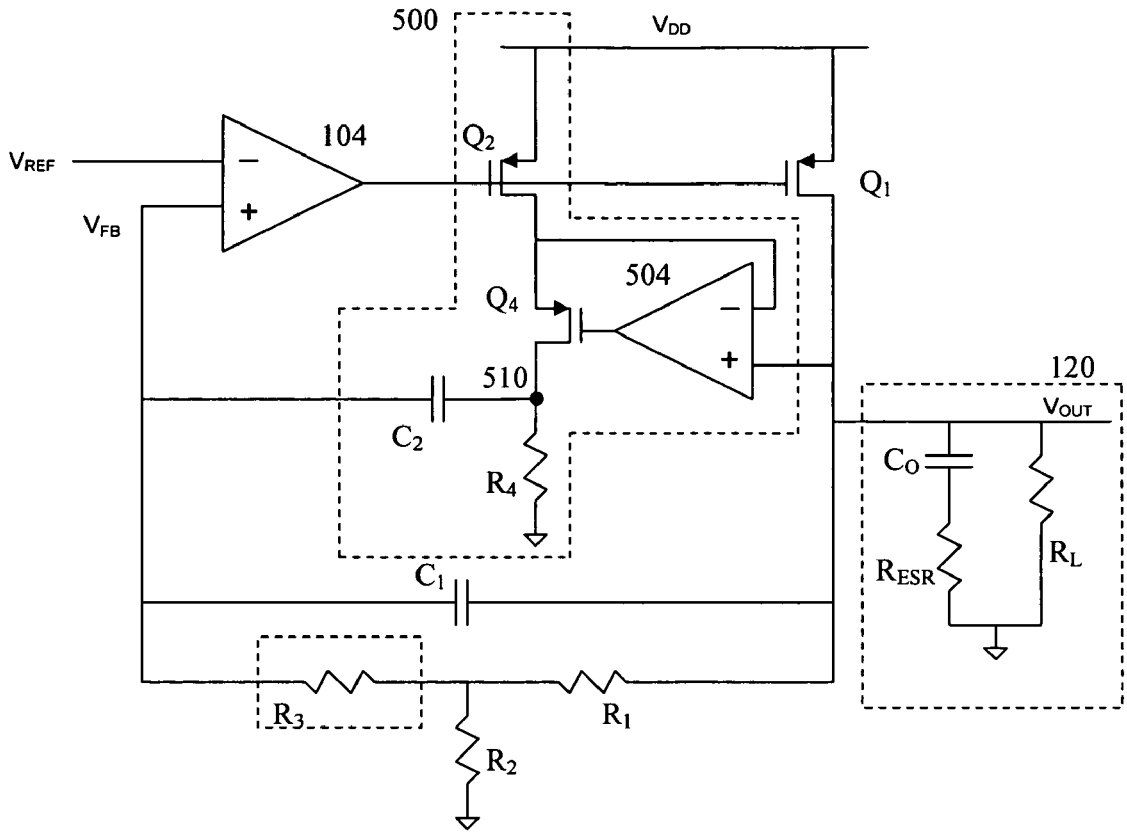

FIG. 5 illustrates another embodiment of the invention, in an LDO regulator application similar to the regulator of FIG. 2 except for the sub-circuit used to emulate the additional ESR. Sub-circuit 500 comprises a feedback FET $Q_2$ and a tracking network consisting of FET $Q_4$ and amplifier 504. The RC network consisting of capacitor $C_2$ and resistor $R_4$ is connected as shown in FIG. 2. The sources of $Q_1$ and $Q_2$ are connected to power source $V_{DD}$ with the drains of $Q_1$ and $Q_2$ connected to the inputs of differential amplifier 504. The output of amplifier 504 drives the gate of $Q_4$ which is connected between $Q_2$ and the RC network. Amplifier 504 is connected such that the drain voltages of Q1 and Q2 closely follow one another. Forcing these two drain voltages towards equality preserves the desired scaling factor. This is important because the ESR that is added to the circuit is proportional to the scaled current flowing into the RC network from $Q_2$.

Figure 6:
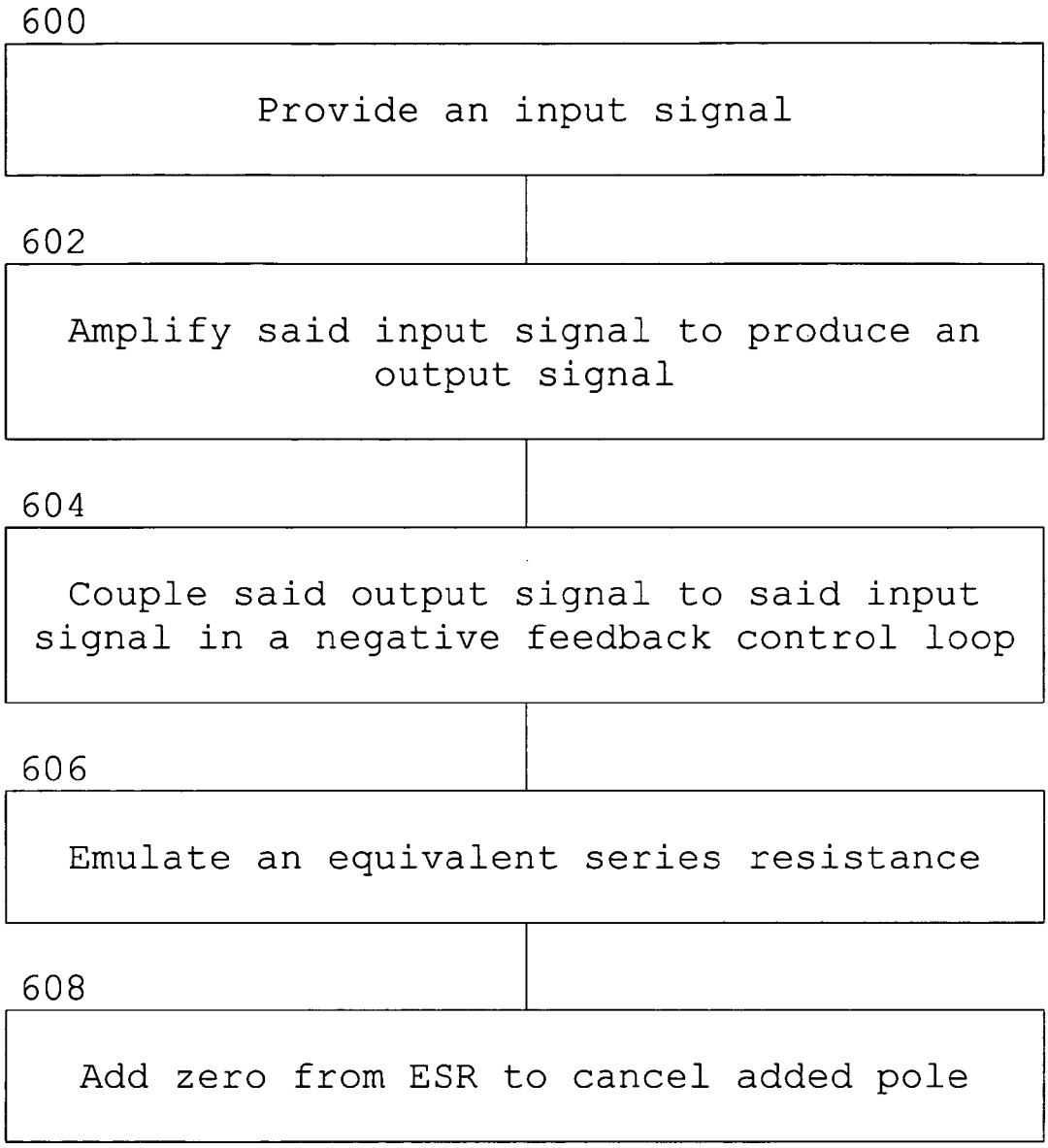
FIG. 6 is a flow diagram of a method for stabilizing a negative feedback control loop in accordance with the invention.

FIG. 6 illustrates the new method for improving stability in negative feedback control loops. First, an input signal is provided in step 600. The input signal can be the output from another system or a reference voltage, for example. The input signal is then amplified to produce an output signal in step 602. The gain associated with the amplification process is selected by the designer and achieved by biasing the control circuit with appropriate components. The output signal then passes through a network and a portion of the output signal is coupled back into the input signal to create a negative feedback control loop as shown in step 604. In step 606, as current passes through the negative feedback control loop, the control circuit emulates an ESR, adding a zero to the transfer function as shown in step 608. The placement of the zero in the transfer function depends on the value of the ESR that is emulated by the circuit.

Some typical part values from the embodiments above are as follows:

$R_1$=625 kΩ;
$R_2$=200 kΩ;
$R_3$=250 kΩ;
$R_4$=5 kΩ;
$C_0$=2.2 μF;
$C_1$=4.5 pF;
$C_2$=1 pF;
$Q_1$: width=30,000 μm; length=0.6 μm;
$Q_2$: width=8 μm; length=0.6 μm.

The values above may vary according to a particular application and are not meant to limit the invention in any manner.

While particular embodiments of the invention have been shown and described, numerous variations and alternate embodiments will occur to those skilled in the art. For example, while described in connection with LDO linear regulators, the invention is applicable to many different applications utilizing control circuits, particularly those that include negative feedback loops. Although various component combinations have been described herein, other embodiments and component combinations will occur to those skilled in the art and may be used to realize the claimed invention. Accordingly, it is intended that the invention be limited only in terms of the appended claims.

I claim:

1. A control circuit that provides an output signal in response to an input signal comprising:

a negative feedback control loop with at least one input stage and at least one output stage, said output stage having a first equivalent series resistance (ESR);

a first capacitive element connected to couple said output signal back into said negative feedback control loop; and a sub-circuit that emulates a second ESR, said sub-circuit connected to ground through a resistive element, said sub-circuit comprising a second capacitive element connected to couple said sub-circuit into said negative feedback control loop;

wherein said second ESR is a scaled version of said first ESR and is AC-coupled into said control loop such that a zero is added into said control loop at a desired frequency.

2. The circuit of claim 1, further comprising a load circuit driven by said control circuit.

3. The circuit of claim 1, wherein said output stage comprises an output transistor.

4. The circuit of claim 3, wherein said sub-circuit comprises:

a feedback transistor scaled in size with said output transistor; and an RC network characterized by said second ESR.

5. The circuit of claim 4, wherein said resistive element comprises:

a source resistor connected in series with the source of said feedback transistor.

6. The circuit of claim 3, wherein said sub-circuit comprises:

a feedback transistor scaled in size with said output transistor; and wherein said resistive element comprises a variable resistive network that scales its resistance in proportion to a load current through said load circuit, forcing said zero to track said load current.

7. The circuit of claim 3, wherein said sub-circuit comprises:

a feedback transistor scaled in size with said output transistor;

an RC network coupling said sub-circuit to said control loop; and a tracking network connected to keep the drain voltages of said output transistor and said feedback transistor substantially equal.

8. The circuit of claim 1, further comprising:

a feedback resistor that adds impedance to the said control loop and allows said output signal to be AC-coupled into said control loop when said control loop is operating at unity gain.

9. The control circuit of claim 1, wherein said output stage and said sub-circuit employ field effect transistors (FETs).

10. A control system comprising:

an input terminal accepting an input signal;

an output stage having an associated equivalent series resistance (ESR);

an amplifier circuit in an control loop that generates a gain from said input terminal to said output stage;

a current mirror circuit that produces a scaled current proportional to the current at said output terminal;

a resistive network connected to ground and scaled to a have desired ESR proportional to the ESR of said output stage, said resistive network responding to said scaled current to generate feedback signal;

a first coupling capacitor connected to couple said resistive network to said control loop; and a second coupling capacitor connected to couple said feedback signal to said control loop.

11. The control system of claim 10, further comprising a load circuit driven by said control system.

12. The control system of claim 11, wherein said resistive network is characterized by a resistance that varies proportionally with the current to said load circuit.

13. The control system of claim 10, wherein said control loop further comprises:

a feedback resistor that adds impedance to the said control loop and allows the signal at said output stage to be AC-coupled into said control loop when said control loop is operating at unity gain.

14. The control system of claim 10, wherein said resistive network comprises:

a feedback field effect transistor (FET); and an RC circuit in series with said feedback FET.

15. The control system of claim 14, wherein said resistive network further comprises:

a source resistor connected in series with the source of said feedback FET.

16. The control system of claim 10, wherein said current mirror circuit comprises:

an output FET; and a feedback FET, said feedback FET and said output FET connected to have a common gate voltage.

17. The control system of claim 16, wherein said resistive network comprises:

a tracking circuit connected to substantially equalize the drain voltages of said feedback FET and said output FET.

18. The control system of claim 10, wherein the ESR of said resistive network adds a zero into the transfer function of said control system, enabling said control system to maintain a phase margin of approximately fifty (50) degrees or more when said gain is at least unity.

19. A method for improving stability in a negative feedback control loop comprising:

providing an input signal;

amplifying said input signal with an amplifying device to produce an output signal;

coupling at least a portion of said output signal back into said amplifying device in a negative feedback control loop, said control loop having a characteristic transfer function;

emulating an equivalent series resistance (ESR) with an emulator circuit within said control loop such that a zero is introduced into said transfer function at a desired frequency;

coupling said emulator circuit to said negative feedback control loop through a capacitive element; and grounding said emulator circuit through a resistive element.

20. The method of claim 19, wherein said output signal drives a load circuit.

21. The method of claim 19, wherein the amplification of said input signal introduces a dominant first pole and a second pole.

22. The method of claim 21, wherein said zero compensates for said second pole.

23. The method of claim 19, wherein said control loop operates with a phase margin of approximately fifty (50) degrees or more when said gain is at least unity.

* * * * *